US006637106B2

(12) United States Patent
Sato et al.

(10) Patent No.: US 6,637,106 B2
(45) **Date of Patent: *Oct. 28, 2003**

(54) METHOD FOR MANUFACTURING LINKAGE TERMINAL

(75) Inventors: Kei Sato, Shizuoka-ken (JP); Sanae Kato, Shizuoka-ken (JP)

(73) Assignee: Yazaki Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/437,156

(22) Filed: Nov. 10, 1999

(65) Prior Publication Data

US 2001/0049877 A1 Dec. 13, 2001

(30) Foreign Application Priority Data

Nov. 13, 1998 (JP) ..... 10-324086

(51) Int. Cl.[7] ..... H01R 43/02

(52) U.S. Cl. ..... 29/878; 29/874; 29/876; 29/882; 439/885

(58) Field of Search ..... 29/874, 876, 877, 29/878, 879, 882, 884, 747, 749; 439/92, 497, 885

(56) References Cited

U.S. PATENT DOCUMENTS

| | | | | | |
|---|---|---|---|---|---|
| 4,027,131 | A | * | 5/1977 | Aidn et al. | 200/246 |
| 4,684,203 | A | * | 8/1987 | Bihler | 29/876 |
| 5,030,138 | A | * | 7/1991 | Capp et al. | 439/497 |
| 5,619,794 | A | * | 4/1997 | Hokazono | 29/884 |

FOREIGN PATENT DOCUMENTS

JP 8-64314 3/1996

* cited by examiner

*Primary Examiner*—Richard Chang
(74) *Attorney, Agent, or Firm*—Finnegan, Henderson, Farabow, Garrett & Dunner, L.L.P.

(57) ABSTRACT

A method for manufacturing a linkage terminal mounted in a housing of a joint connector is disclosed. The method comprises a step of providing first and second terminal elements. Each terminal element includes a strip-shaped carrier and terminals integral with the carrier. The terminals are arranged at equal intervals along a longitudinal direction of the carrier and extend generally perpendicularly from the carrier. The carrier is wound in a reel. The method further comprises a step of unwinding the reel and shifting the first and second terminal elements relative to each other in the longitudinal directions of the carriers to stack the first and second terminal elements. The method further comprises a steps of welding the carriers of the first and second terminal elements intermittently along the longitudinal directions of the carriers.

7 Claims, 8 Drawing Sheets

METHOD FOR MANUFACTURING LINKAGE TERMINAL

OF THE INVENTION

1. Field of the Invention

The present invention relates to a method for manufacturing a linkage terminal mounted in a housing of a joint connector.

2. Description of the Related Art

As a connector using a linkage connector, there has been known a connector assembly disclosed in Japanese Patent Publication (JP-A) No. 8-64314. As illustrated in FIG. 1, after lead frames 2, 3 each including a plurality of contacts 1 are stacked and welded continuously, an insulation block 4 is fixed to the lead frames which have been welded, and strip-shaped carriers of the lead frames 2, 3 are removed. As shown in FIG. 2, each contact 1 of the connector having such a structure is inserted in a contact accommodation space formed in another insulation housing block 5.

SUMMARY OF THE INVENTION

In the above conventional connector, however, as the lead frames 2, 3 are continuously welded, there is a drawback that a welding time is extended and productivity is limited by the welding time.

Also, the insulation housing blocks 4, 5 have structures different from each other so that insulation housing blocks of kinds of the number corresponding to the number of layers must be prepared in a multi-layer structure of the insulation housing blocks 5.

Also, since the lead frames 2, 3 must be cut in their stacked state, there is a drawback that it is difficult to cut the lead frames 2, 3

In this manner, in the conventional connector, as much manufacturing time is taken, it is difficult to reduce manufacturing cost. Also, as the contacts 1 are bent after the lead frames 2, 3 have been stacked double, there is a drawback that, when the carrier portions of the lead frames 2, 3 are welded, stress is liable to be applied on the welded portions, which may be peeled off by the stress.

Therefore, an object of the present invention is to provide a linkage terminal of a joint connector which can be manufactured with a high manufacturing efficiency and where secure electrical connection can be made.

In order to achieve the above object, a manufacturing method of a linkage terminal mounted in a housing of a joint connector according to the present invention comprises a first step and a second step. In the first step, a first terminal element and a second terminal element are shifted in their longitudinal directions relative to each other and stacked one on the other. Each of the terminal elements has a strip-shaped carrier and terminals formed integrally with the carrier. The terminals are arranged along the longitudinal direction of the carrier at equal intervals and extend from the carrier generally perpendicularly to the carrier. In the second step, the carriers of the first and second terminal elements are mutually welded along their longitudinal direction.

According to the above method, carriers of first and second terminal elements are mutually welded so that distances or intervals between terminals can be made small. As a result, a housing of a joint connector in which a linkage terminal is mounted can also be made compact.

In the second step, the carriers may be welded intermittently along their longitudinal directions.

According to the above method, as carriers are welded intermittently, a time required for welding is shortened, which results in reduction in manufacturing cost.

In the first step, the first terminal element and the second terminal element are stacked in a state where they are shifted relative to each other by half of a pitch between terminals in longitudinal directions of the carriers.

According to the above method, first and second terminal elements are shifted by half of a pitch, so that terminals can be disposed at equal small pitches between adjacent terminals.

In the second step, portions of the carriers from which the terminals extend may be welded.

According to the above method, as only portions of carriers corresponding to terminals have been welded, portions of the carriers to be cut are not welded and they can easily cut off. Thereby, a productivity can be improved.

The method further comprises a step for cutting the carriers along directions perpendicular to their longitudinal directions according to the number of terminal accommodation portions of the housing of the joint connector after the carriers may be welded.

According to the above method, as the carriers are cut corresponding to the number of terminal accommodation portions of a housing where a linkage terminal is accommodated, the linkage terminal can be provided with a configuration where it can immediately used in a joint connector.

The method further comprises a step for bending boundary portions between the carriers and the terminals such that the terminals are arranged with the same height after the carriers may be welded.

According to the method, as height positions of terminals can be adjusted by a bending machine, a linkage terminal with an excellent assembling easiness to a housing of a joint connector can be provided.

In the bending step, the boundary portions are bent by a bending machine.

According to the above method, as height positions of terminals can be adjusted by a bending machine, a linkage terminal with an excellent assembling easiness to a housing of a joint connector can be provided.

DESCRIPTION OF THE PREFERRED EMBODIMENTS

Figure 1:
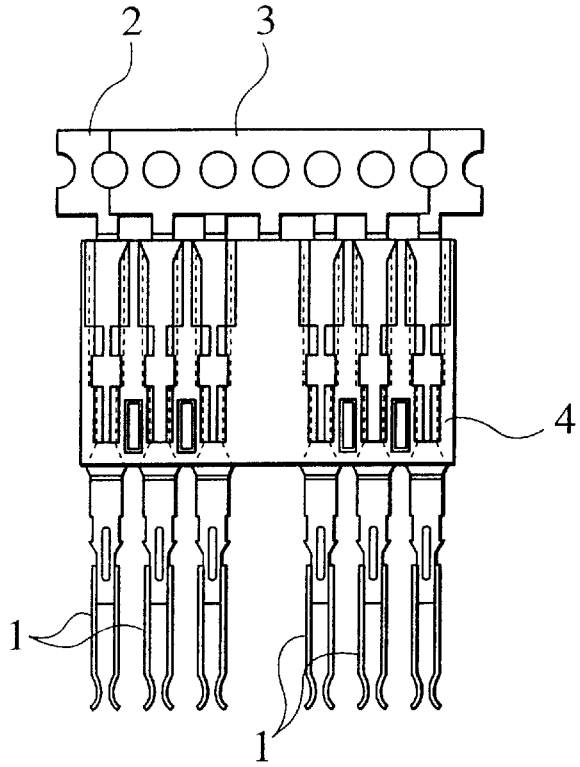
FIG.1 PRIOR ART
FIG. 1 is a plan view of a conventional connector.
Figure 2:
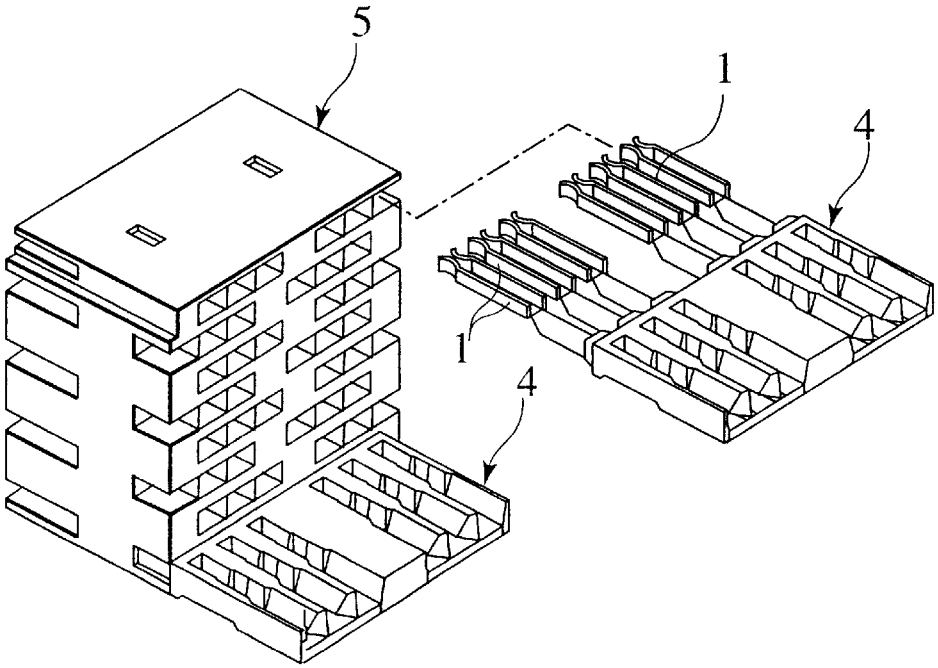
FIG.2 PRIOR ART
FIG. 2 is a perspective view of the conventional connector.

A linkage terminal mounted in a housing of a joint connector according to the present invention will be explained in detail with reference to an embodiment illustrated in the drawings.

FIGS. 3 to 11 illustrates an embodiment of a manufacturing method of a linkage terminal according to the invention. First, an entire structure of a joint connector will be explained prior to explanation of the manufacturing method.

Figure 5:
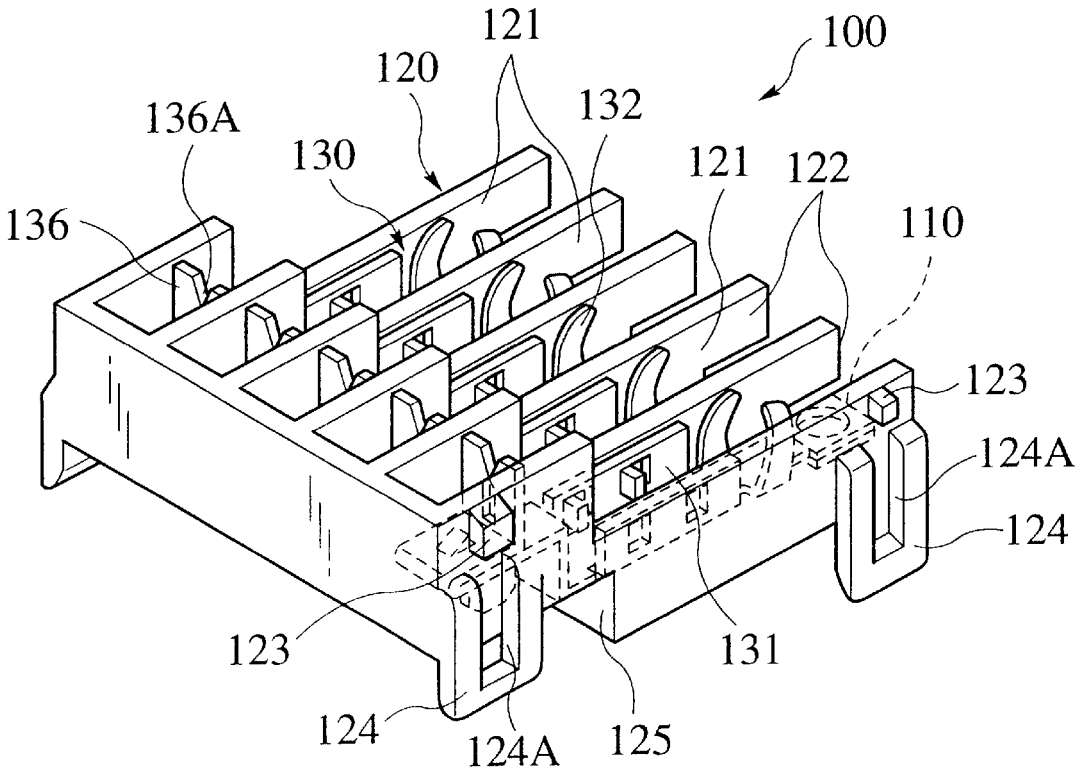
FIG. 5 is a perspective view illustrating a state where the linkage terminal has been accommodated in a housing.

FIG. 5 illustrates a module 100 of the joint connector of this embodiment. The module 100 comprises a linkage terminal 110 and a housing 120 accommodating the linkage terminal 110.

Figure 6:
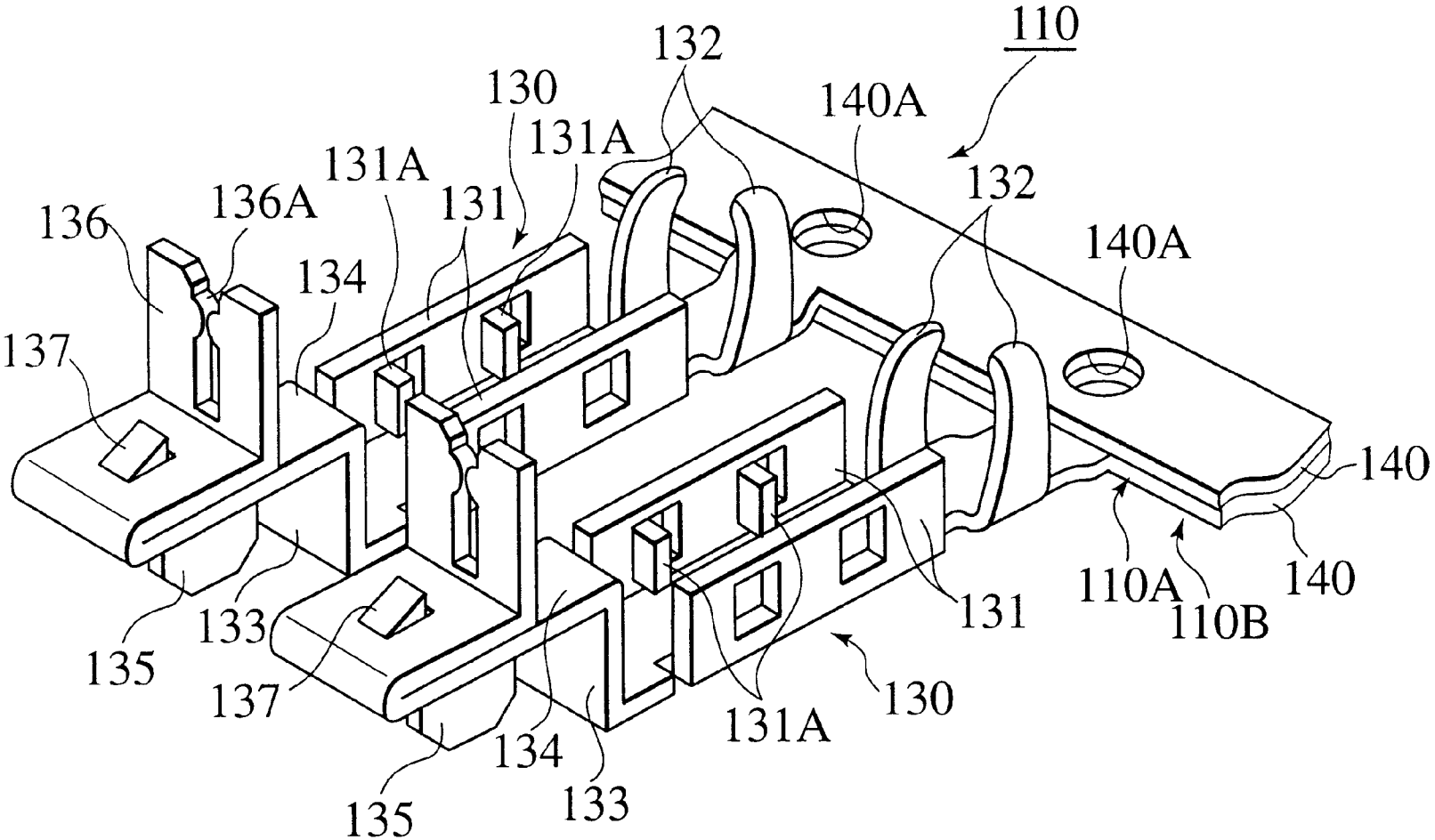
FIG. 6 is a perspective view illustrating the linkage terminal.
Figure 7:
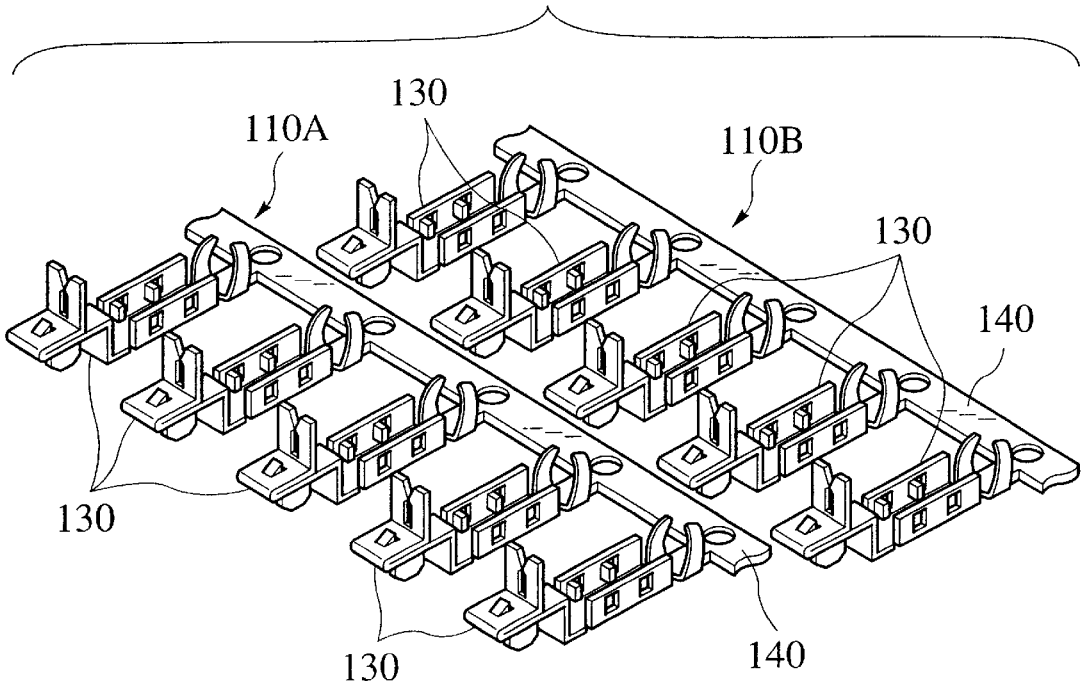
FIG. 7 is a perspective view illustrating the first and second terminal elements.

As illustrated in FIG. 6, the linkage terminal 110 comprises first and second terminal elements 110A, 110B each of which is provided by working a metal plate. Each of the terminal elements 110A, 110B comprises a plurality of terminals 130 arranged in parallel and carriers 140 connecting the terminals 130. The terminals 130 are connected via the carriers 140 in a multi-continuous manner.

Formed in the housing 120 made of resin material are accommodation grooves 121 partitioned by partition walls 122 and arranged in parallel. The respective accommodation grooves 121 correspond to the respective terminals 130 belonging to one linkage terminal 110, each terminal 130 has a wire holding portion holding a wire.

Two protrusions 123 for module engagement are formed at an upper portion of each of a pair of outside faces of the housing 120 opposed to each other. Locking pieces 124, 124 for engagement extend downwardly from portions of the outside face positioned below the protrusions 123 for module engagement. An opening 124A into which a protrusion 123 for module engagement of another housing 120 is formed in each engaging lock piece 124.

Next, the structure of the terminal 130 constituting the linkage terminal 110 will be explained with reference to FIG. 6. A pair of wire press-fitting plates 131, 131 erected from both side portions of the terminal 130 are formed on an intermediate portion, in a longitudinal direction, of the terminal 130. Wire press-contacting pieces 131A, 131A are erected in a cutting manner on each wire press-fitting plate 131. Bending pieces 132 erected from both side portions of the terminal 130 are formed at an intermediate portion between the wire press-fitting plates 131 and the carrier 140.

A standing piece 133 along a standing wall 125 of the housing 120 is disposed nearer to a distal end side than the wire press-fitting plates 131. A horizontal plate portion 134 extending forward is formed at an upper portion of the standing piece 133. A plugging-in piece 135 for connection bend downwardly and serving as a connecting portion is formed on the horizontal plate portion 134. A piece 136 to be connected which is bent upwardly to be erected by a predetermined distance and which serves as a portion to be connected is formed on the horizontal plate portion 134.

A slit 136A is formed in the piece 136 to be connected. The plugging-in piece 135 can be plugged in the slit 136A. A protrusion 137 for engagement extending obliquely upward and rearward is disposed in front of the piece 136 to be connected.

Figure 11:
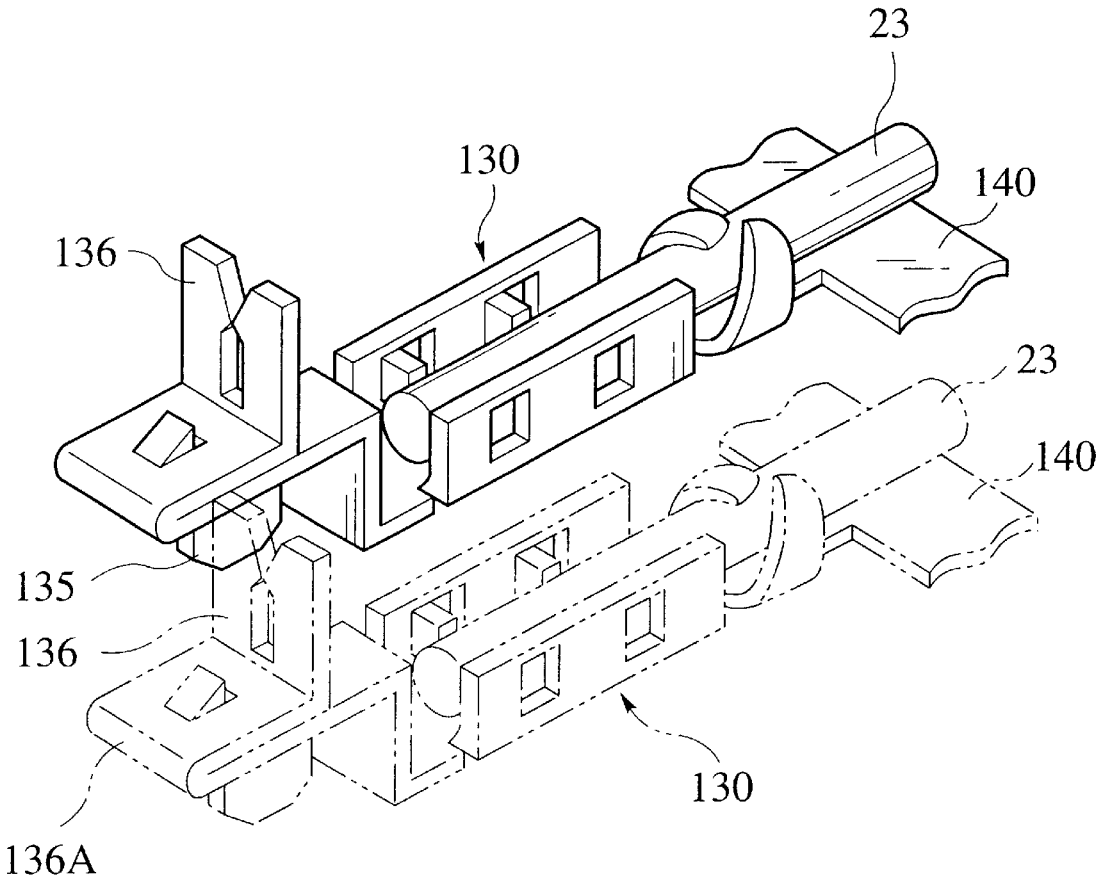
FIG. 11 is a perspective view illustrating a connected state between terminals.

As illustrated in FIG. 11, in order to connect a wire to the terminal 130, a conductive wire (not shown) is press-fitted between the wire press-fitting plates 131, 131 to be connected to the wire press-contacting pieces 131A. Then, a portion of the wire 23 which is covered with an insulating cover is disposed between the bending pieces 132 and the wire 23 is fixed to the terminal 130 by bending the bending pieces 132.

Slits (not shown) serving as openings are formed in the housing 120 accommodating the linkage terminal 110 comprising the terminals 130 connected in a multi-continuous manner. The plugging-in piece 135 of each terminal 130 passes through each slit. The plugging-in piece 135 which has passed through the slit projects downward from a lower face of the housing 120.

Figure 9:
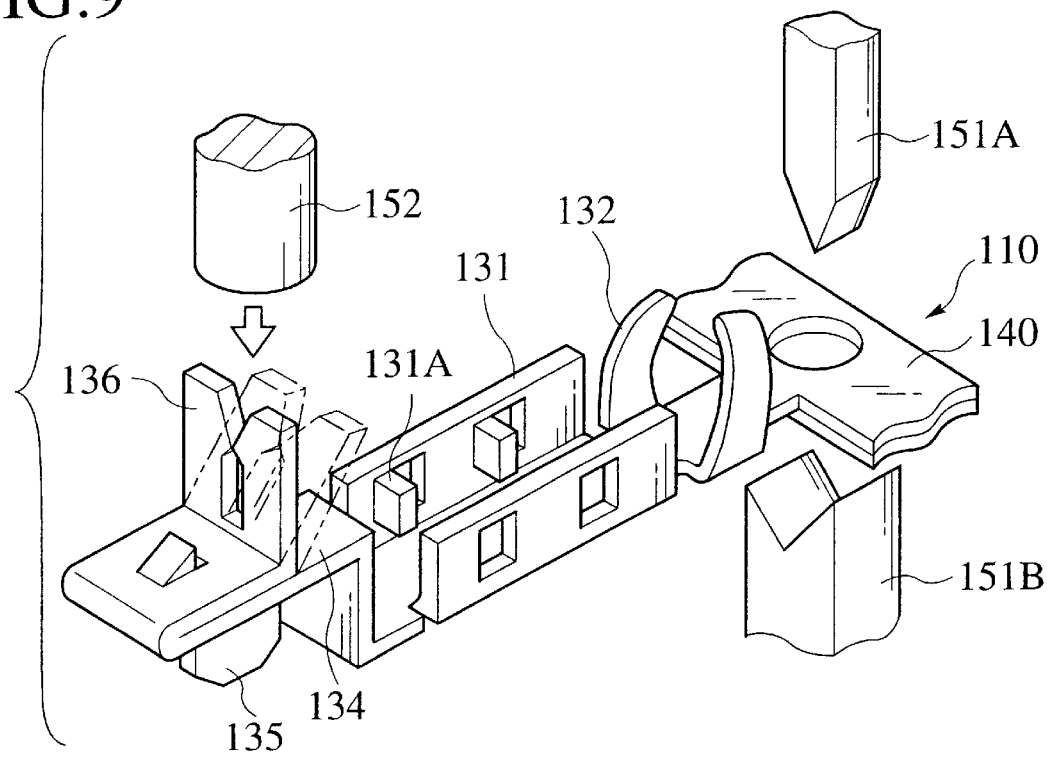
FIG. 9 is a perspective view illustrating a state where the linkage terminal is worked by a jig.

As illustrated in FIG. 9, in order to separate the multi-continuous linkage terminal 110 into individual terminals 130 according to a connection circuit configuration required, after the linkage terminal 110 is accommodated in the housing 120, carrier cutting jig 151A and 151B are pushed on the carrier 140 and the carrier 140 is cut off by the jigs 151A and 151B.

When the modules 100 each having the housing 120 accommodating a plurality of the terminals 130 are stacked and a connection between the upper and lower modules is performed, and there is one of pairs of corresponding upper and lower terminals 130, 130 where connection between the corresponding upper and lower terminals 130 are not required, the piece 136 to be connected of the lower terminal 130 of the pair of the corresponding upper and lower terminals 130 whose connection is not required is fallen down by using such a bending jig 152, as illustrated in FIG. 9.

Figure 10:
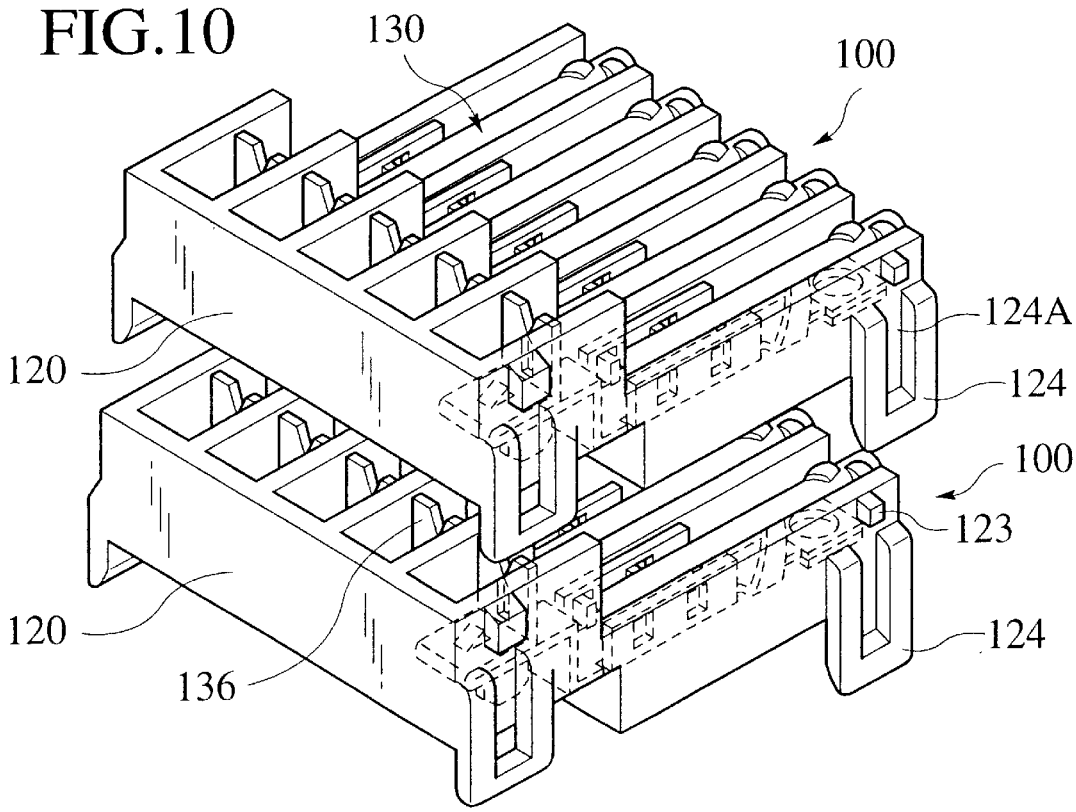
FIG. 10 is a perspective view illustrating how to assemble modules.

As illustrated in FIG. 10, in order to stack the modules 100 vertically, each module 100 having the housing 120 accommodating a plurality of the terminals 130, a plurality of the modules 100 are stacked one on another in a state where a wire has been connected to each terminal 130 in each housing 120. Then, the protrusions 123 for module engagement of the lower housing 120 are fitted into the openings 124A of the locking pieces 124 for engagement of the upper housing 120. Thereby, the upper and lower modules 100 are locked to each other in a stacked state.

At this time, as illustrated in FIG. 11, the plugging-in piece 135 of the terminal 130 of the terminals in the upper housing 120 which is required to be electrically connected to a corresponding terminal 130 in the lower housing 120 is plugged in the slit 136A of the piece 136 to be connected of the corresponding terminal 130 in the lower housing 120 so that corresponding terminals 130 in the upper and lower housings 120 are electrically connected to each other.

Next, the manufacturing method of the linkage terminal 110 will be explained with reference to FIGS. 3, 4A, 4B, and 6 to 8.

The linkage terminal 110 comprises two terminal elements 110A, 110B having the structure illustrated in FIG. 6. Both the terminal elements 110A, 110B have the same continuous configuration. The two terminal elements 110A, 110B are stacked in a state where they have been shifted by half of a pitch and the carriers 140 are welded such that the terminals 130 of the terminal element 110A and the terminals of the terminal element 110B are arranged in a staggered manner.

Figure 3:
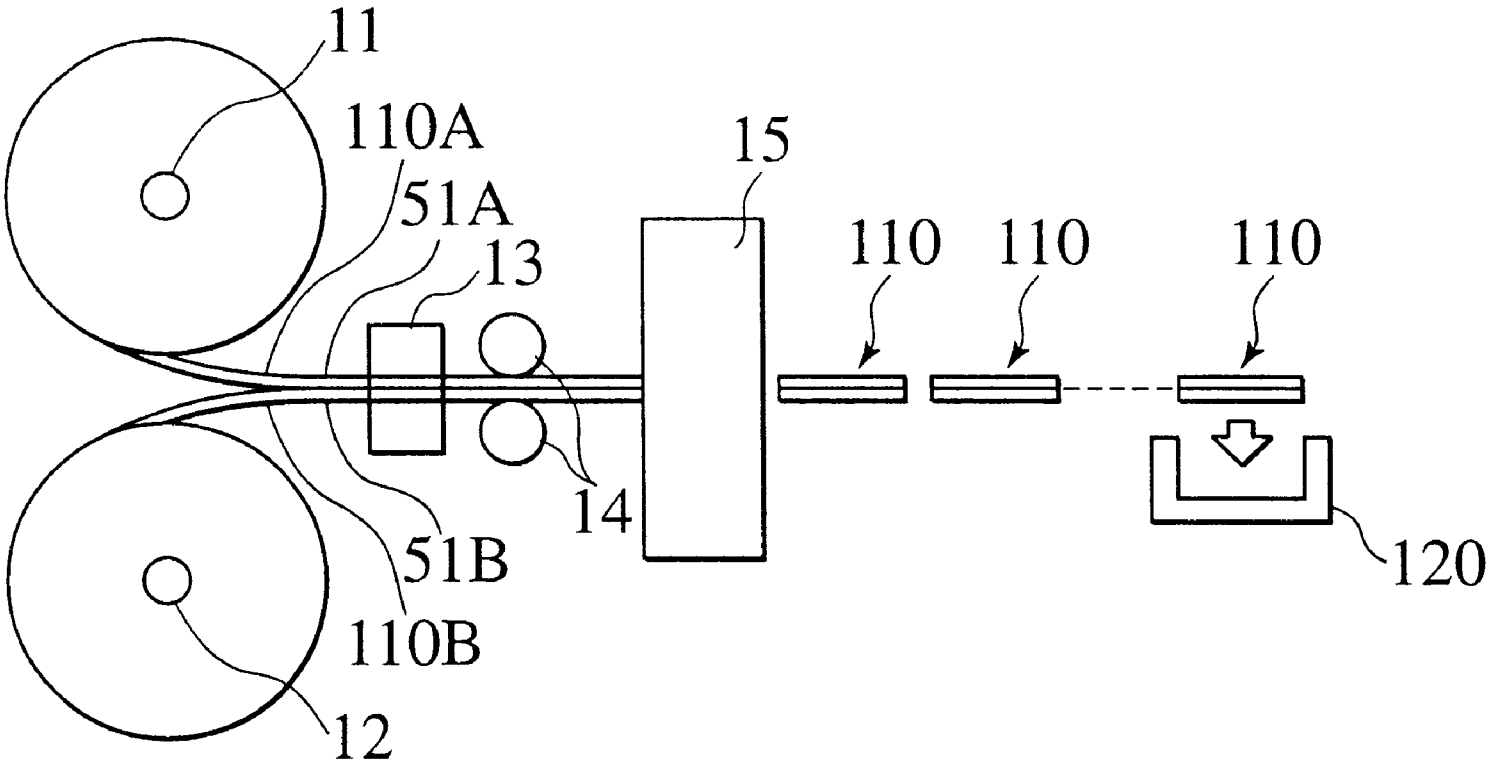
FIG. 3 is an explanative view illustrating an embodiment of a manufacturing method of a linkage terminal according to the present invention.
Figure 4A:
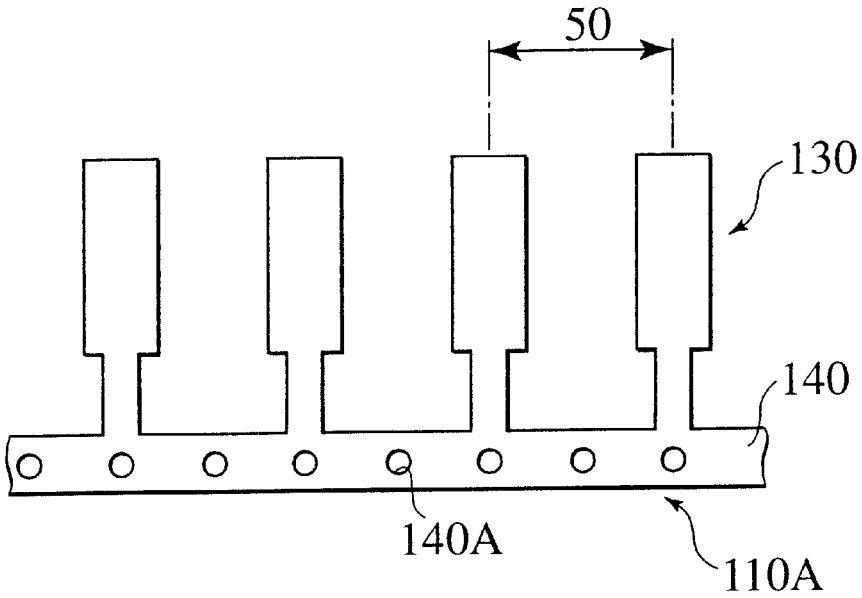
FIG. 4A is a plan view illustrating a first terminal element.
Figure 4B:
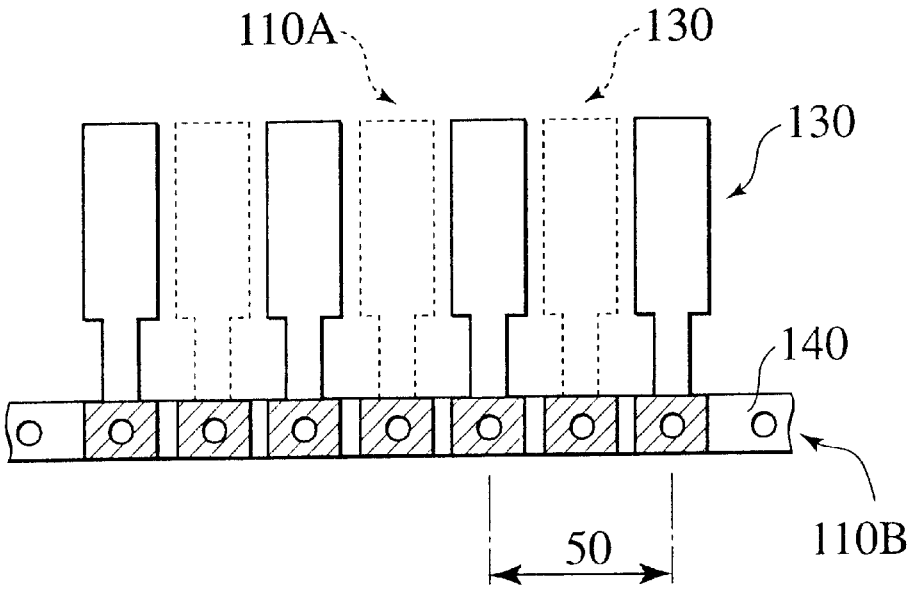
FIG. 4B is a plan view illustrating the first terminal element and a second terminal element which have been stacked mutually.

As illustrated in FIG. 3, first of all, reels 11, 12 which have been respectively wound with the terminal elements 110A, 110B are disposed to be opposed to each other, the terminal elements 110A, 110B are taken out from the respective reels 11, 12 with half of one pitch shift between the terminal elements 110A, 110B and with their stacked state. The one pitch corresponds to the distance 50. FIG. 4A is a plan view of the terminal element 110A. FIG. 4B is a plan view illustrating a state where the two terminal elements 110A, 110B have been stacked with a half pitch shifting. In FIG. 4B, the first terminal element 110A is represented with a broken line and the second terminal element 110B is represented in a solid line.

Incidentally, positioning holes 140A are formed at half pitch intervals in the carrier 140 of each of the terminal elements 110A, 110B. Accordingly, the corresponding positioning holes 140A are matched with each other between the carriers 140 of the first and second terminal elements 110A, 110B so that the terminal elements 110A, 110B are stacked with the half pitch shifting.

The boundary portions between the terminals 130 and the carriers 140 of the terminal elements 110A, 110B stacked are bent by a bending machine 13 such that they are positioned on a plane (the terminals 130 are arranged at generally even heights). According to such a bending step, the linkage terminal 110 such as illustrated in FIG. 6 is formed.

Next, the carriers 140 of the first and second terminal elements 110A, 110B are welded intermittently by a welding machine 14. The intermittent welding can be obtained by a welding machine 14 turned on intermittently. Hatched portions illustrated in FIG. 4B indicate welded portions.

Figure 8:
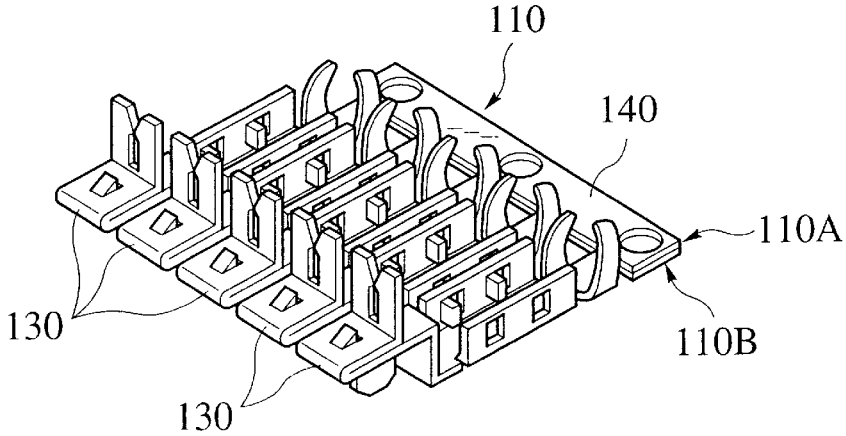
FIG. 8 is a perspective view illustrating the linkage terminal.

Next, as illustrated in FIG. 3, the carrier 140 of the linkage terminal 110 which have been welded and integrated is cut off by a cutting machine 15, for example as illustrated in FIG. 8, so as to corresponding to the housing 120. In this embodiment, as illustrated in FIG. 5, the linkage terminal 110 which has been cut is conveyed to be inserted and mounted in the housing 120.

In the embodiment thus structured, the linkage terminal 110 can be manufactured by using the terminal elements 110A, 110B having the same shape. Therefore, the linkage terminal 110 can easily be manufactured and managed without increasing kinds of parts. Also, the carriers 140 are welded at their portions from which the terminals 130 extend. Therefore, electrical conduction can be secured. Furthermore, in this embodiment, positioning can easily be performed only by matching the positioning holes 140A with each other between the terminal elements 110A, 110B.

In the above, the explanation has been given of each explanation, but the present invention is not limited to the embodiment. Various design modifications may be performed within the gist of the structure of the invention. In the embodiment, for example, the two terminal elements 110A, 110B having the same shape are used for the linkage terminal 110, but the present invention is not limited to these terminal elements.

What is claimed is:

1. A method for manufacturing a linkage terminal mounted in a housing of a joint connector, comprising:

providing first and second terminal elements, each terminal element including a strip-shaped carrier and terminals integral with the carrier, each terminal including a projecting piece configured to be connected to another terminal, the terminals being arranged at equal intervals along a longitudinal direction of the carrier and extending generally perpendicularly therefrom, each of the carriers of the first and second terminal elements being wound in a reel;

unwinding the reels and shifting the first and second terminal elements relative to each other in the longitudinal directions of the carriers to stack the first and second terminal elements;

welding the carriers of the first and second terminal elements intermittently along the longitudinal directions of the carriers; and bending each of the projecting pieces not required to be connected to another terminal.

2. The method according to claim 1, wherein the carriers are mutually welded by a welding machine in the welding step.

3. The method according to claim 1, wherein the first terminal element and the second terminal element are stacked in a state where the terminals are shifted by half of a pitch of the terminals in the shifting step.

4. The method according to claim 1, wherein portions of the carriers from which the terminals extend are welded.

5. The method according to claim 1, further comprising cuffing the carries along a direction perpendicular to the longitudinal directions of the carriers after the carriers are welded such that the terminals correspond in number to terminal housing portions of the housing of the joint connector.

6. A method for manufacturing a linkage terminal mounted in a housing of a joint connector, comprising:

providing first and second terminal elements, each terminal element including a strip-shaped carrier and terminals integral with the carrier, each terminal including a projecting piece configured to be connected to another terminal, the terminals being arranged at equal intervals along a longitudinal direction of the carrier and extending generally perpendicularly therefrom, each of the carriers of the first and second terminal elements being wound in a reel;

unwinding the reels and shifting the first and second terminal elements relative to each other in the longitudinal directions of the carriers to stack the first and second terminal elements;

bending boundary portions between the carriers and the terminals such that the terminals are arranged with generally even heights when the carriers are welded;

welding the carriers of the first and second terminal elements along the longitudinal directions of the carriers after bending the boundary portions; and bending each of the projecting pieces not required to be connected to another terminal.

7. The method according to claim 6, wherein the boundary portions are bent by a bending machine.

* * * * *

UNITED STATES PATENT AND TRADEMARK OFFICE

CERTIFICATE OF CORRECTION

PATENT NO. : 6,637,106 B2
DATED : October 28, 2003
INVENTOR(S) : Kei Sato and Sanae Kato It is certified that error appears in the above-identified patent and that said Letters Patent is hereby corrected as shown below:

Title page,
Item [57], ABSTRACT,
Lines 12-13, "a steps" should read -- a step --.

Column 6,
Line 27, "cuffing" should read -- cutting --; and
"the carries" should read -- the carriers --.

Column 6,
Line 57, insert the following missing claims:

-- 8. The method according to claim 1, wherein the carriers are intermittently welded along the longitudinal directions of the carriers at a surrounding area of positioning holes provided at portions from which the terminals extend in the welding step.

9. The method according to claim 6, wherein the carriers are intermittently welded along the longitudinal directions of the carriers at a surrounding area of positioning holes provided at portions from which the terminals extend in the welding step. --

Signed and Sealed this

Fifteenth Day of June, 2004

JON W. DUDAS
*Acting Director of the United States Patent and Trademark Office*